United States Patent [19]

Patch

[11] 4,098,198

[45] Jul. 4, 1978

[54] TABLE WITH TWO BRACED LEGS

[76] Inventor: Theodore Neel Patch, 4106 Leland St., Chevy Chase, Md. 20015

[21] Appl. No.: 804,730

[22] Filed: Jun. 8, 1977

[51] Int. Cl.[2] ..... A47B 13/00

[52] U.S. Cl. ..... 108/161; 108/49

[58] Field of Search ..... 297/135, 157, 449, 445, 297/439, 425, 426; 5/332; 182/224, 181; 312/208; D6/177; 211/126; 248/441, 127, 152, 174, 188.8; 108/34, 43, 160, 49, 161, 155

[56] References Cited

U.S. PATENT DOCUMENTS

| | | | |
|---|---|---|---|
| D. 165,710 | 1/1952 | Currie et al. | 297/157 X |
| D. 217,261 | 4/1970 | Gianfagna | D6/177 |
| D. 240,184 | 6/1976 | Neuschaefer | D6/177 |
| 510,858 | 12/1893 | Hastings | 108/160 |
| 581,589 | 4/1897 | Houghton | 108/132 |
| 1,232,079 | 7/1917 | Pocock | 297/135 |
| 1,460,216 | 6/1923 | Smith | 108/34 |
| 1,694,146 | 12/1928 | Sattler et al. | 297/439 |
| 1,694,283 | 12/1928 | Reid | 312/255 |
| 1,843,814 | 2/1932 | Hallowell et al. | 248/174 X |
| 3,747,539 | 7/1973 | Calzaretto | 108/129 |
| 3,971,327 | 7/1976 | Critchett | 108/159 |

OTHER PUBLICATIONS

Woodworking, Published 1907 by David McKay, pp. 246, 540.

Home Craftsman, 8-1949, pp. 22 & 23.

*Primary Examiner*—James T. McCall

*Attorney, Agent, or Firm*—Young & Thompson

[57] ABSTRACT

The table has a rectangular top and two rectangular legs that support the top and diverge downwardly from each other. The upper ends of the legs are chamfered to fit flat against the underside of the table. Crosspieces on the inner upper sides of the legs are secured to the underside of the table and have chamfered surfaces against which the upper ends of the legs are secured. Ribs extend lengthwise of the table and have downwardly depending ends each of which is secured to a side edge of the corresponding leg by fasteners that are spaced below the underside of the tabletop a distance substantially greater than the thickness of the crosspiece and substantially greater than the thickness of the major portion of the length of the ribs between the ends of the ribs.

7 Claims, 4 Drawing Figures

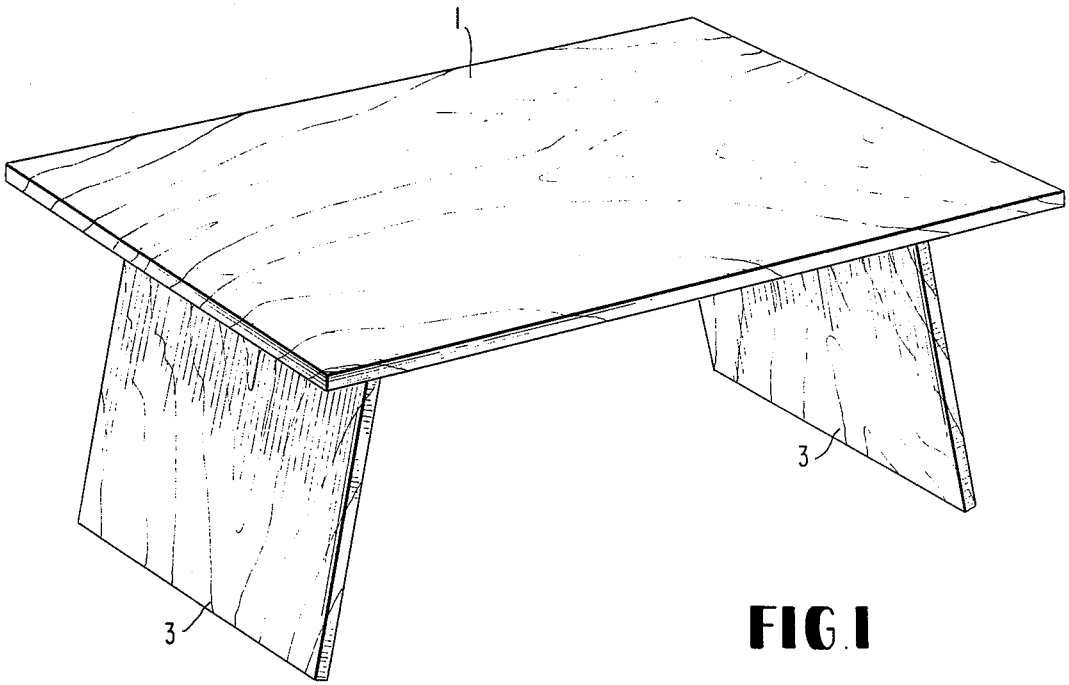
FIG. 1
FIG. 2
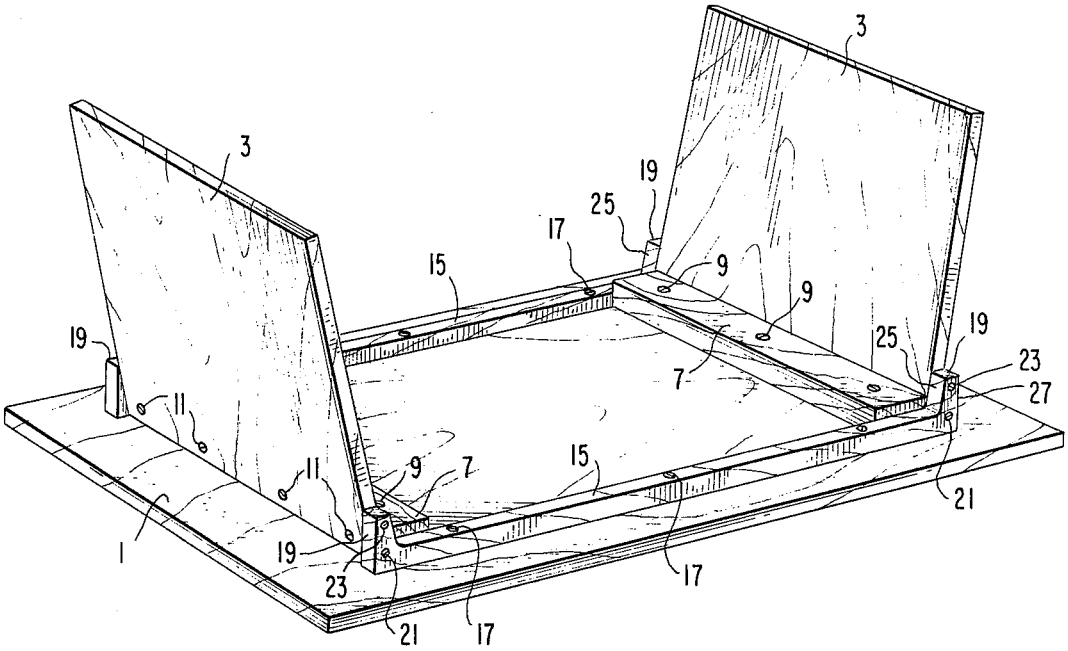

TABLE WITH TWO BRACED LEGS

The present invention relates to small tables of the type of bed tables, occasional tables, and the like. In such tables, it is often desirable, for aesthetic or other reasons, that the legs diverge downwardly away from each other.

However, problems are encountered in the construction of such tables, as it is difficult to brace the legs without resorting to a type of construction that is heavy or expensive or that occupies so much space as to impede the intended use of the table.

Accordingly, it is an object of the present invention to provide a table of the type described above, in which the legs are strongly braced.

Another object of the present invention is the provision of such a table, which will be relatively simple and inexpensive to manufacture, and rugged and durable in use.

Other objects and advantages of the present invention will become apparent from a consideration of the following description, taken in connection with the accompanying drawings, in which:

FIG. 1 is a top perspective view of a table according to the present invention;

FIG. 2 is a bottom perspective view thereof;

Figure 3:
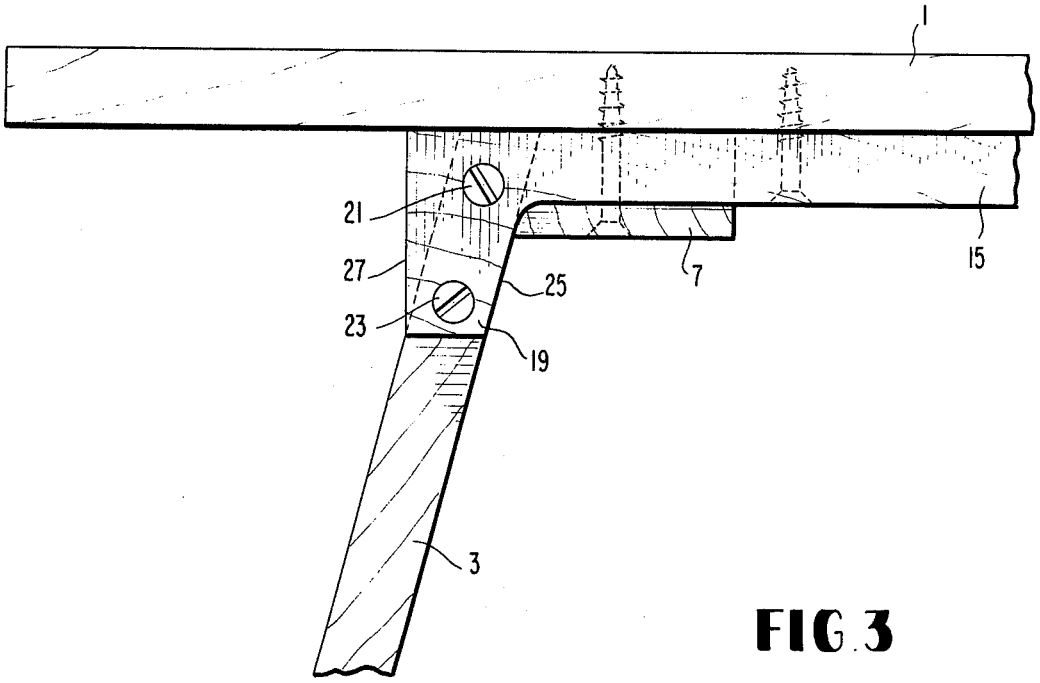
FIG. 3 is an enlarged fragmentary side elevational view of one end of the table.

Referring now to the drawings in greater detail, there is shown a table according to the present invention, comprising a flat horizontal rectangular top 1 and a pair of flat rectangular legs 3 secured to the underside of the table and diverging downwardly away from each other. For simplicity of construction, legs 3 are preferably flat imperforate panels whose width is equal to most of the width of top 1. Along their upper edges, legs 3 are provided with chamfers 5, at such an angle that the upper ends of legs 3 rest flat against the underside of top 1.

Crosspieces 7 are secured by fasteners 9 to the underside of top 1 against the upper inner side edge portions of legs 3. Fasteners 11 extend through the upper ends of legs 3 and into crosspieces 7. The crosspieces 7 have chamfers 13 on their sides adjacent legs 3, at such an angle that legs 3 and crosspieces 7 lie flat against each other in this area.

Two ribs 15 extend most of the length of top 1 and are secured to the underside of top 1, parallel to the longest side edges of top 1, by fasteners 17. Ribs 15 have downwardly depending ends 19 that are secured to the adjacent side edges of legs 3 by upper fasteners 21 and lower fasteners 23. Ends 19 have inner side edges 25 and outer side edges 27. The inner side edges 25 of each rib 15 are at an obtuse angle to the length of the associated rib 15 and diverge downwardly from each other at about the same angle as legs 3. Outer edges 27 of ends 19 are preferably substantially upright, so that edges 25 and 27 of each end 19 converge downwardly.

It is preferred that the material of top 1, legs 3, crosspieces 7 and ribs 15 be wood. Particularly for ribs 15, composition board or plywood is highly desirable, so as to impart strength to the ends 19 thereof. All such materials, namely, natural wood, plywood and chip board, etc., are referred to hereinafter as "wood".

Fasteners 9, 11 and 17 can be screws or nails and can be replaced by gluing. Fasteners 21 and 23, however, should be screws or nails. Fasteners 21 can if desired be omitted, as fasteners 23 provide ample strength for the connection between the ribs and the legs. The fasteners 23 should be at a distance below top 1 which is substantially greater, and preferably at least twice as great, as the height of rib 15 between ends 19.

It will be recognized that a number of advantages inhere in the construction described above. In the first place, a table is provided whose leg construction is very simple, comprising merely a pair of rectangular plates. The span of the lower ends of these plates is desirably great, because the plates diverge downwardly away from each other. The downward divergence of the legs insures that there will be substantially no stress acting on the legs in a direction to move them toward each other; therefore, it is necessary to provide strong bracing for the legs only in one direction, namely, in a direction to prevent swinging of the legs away from each other. The crosspieces 7 provide this bracing, not only because of their position on the inner sides of the upper ends of the legs, but also because of the chamfer 13 on the crosspieces 7. The chamfer 5 on the legs 3, in turn, reinforces the legs against swinging movement toward each other.

The construction of the ribs 15 has a number of advantages. In the first place, the fact that the ribs 15 are continuous from one leg to the other, and not discontinuous in the middle of the tabletop, insures that the stress in the ribs is borne at least partially in tension throughout the length of the ribs. There is thus a distribution of the stresses imposed on the ribs by the legs 3, throughout the entire length of the ribs, so that all the material of the ribs, and not merely that which is located at and adjacent the fasteners 17 or the ends 19, contributes to the bracing of the legs 3. Also, the fact that the ribs 15 between their ends 19 are of a depth which is substantially less than the height of the ends 19, is highly advantageous for securing the ribs beneath the tabletop. Fasteners 17 for securing ribs 15 to the underside of top 1 need be only relatively short, and hence subjected only to lower lateral twisting forces than would be longer fasteners. Moreover, regardless of the type of securement of ribs 15 beneath tabletop 1, whether by fasteners 17 or gluing, the low height of ribs 15 between ends 19, insures that forces applied to these ribs sideways will not exert so great a couple at the juncture between the rib and the tabletop, as to wrench the rib loose from the tabletop. Furthermore, the reduced height of ribs 15 means that there is more room beneath the tabletop, when the table is used for example as a bed table or in another utilization requiring the provision of maximum space below the tabletop 1 and between the legs 3.

The angles of edges 25 and 27 of ends 1 is also important. By virtue of the angles of these edges, the ends 19 are thickest at the point where maximum bending stress is applied, at the same time that substantially no useful space beneath the tabletop and between the legs is occupied by ends 19. Moreover, the obtuse angle between ends 19 and the remainder of ribs 15 reduces the stress concentration at the juncture between edges 25 and the intermediate portions of ribs 15.

As indicated above, the fasteners 21 can if desired be omitted; but the fasteners 23 and their location are very important. The location of the fasteners 23 a substantial distance below tabletop 1, namely, a substantially greater distance than the height of the intermediate portions of ribs 15, and preferably at least twice that height, and the location of the fasteners 23 a substantial distance below crosspieces 7, insures that the stress between fasteners 23 and legs 3 will be at a minimum. In this regard, legs 3 tend to act as a first-class lever about fasteners 23 as a fulcrum, the point of the force application or input being the lower end of the legs 3 and the resistance or output of the first-class lever being the interface between the upper ends of legs 3 and the crosspieces 7. By the construction of the present invention, this latter point of application or output is spaced a substantial distance from the fulcrum provided by fasteners 23, so that the force multiplication, and hence the reaction between fasteners 23 and legs 3, is greatly reduced.

Viewed another way, the height of the crosspieces 7 is small relative to the height of the ends 19. This low height of the crosspieces 7 not only contributes to the relatively low reaction force between fasteners 23 and legs 3, described above, but also contributes to the provision of maximum usable space beneath the tabletop and between the legs 3.

The fact that the legs 3 are rectangular and imperforate, means that they are not subject to racking or twisting, but that substantially all forces imposed on and by legs 3 will be received and applied in vertical planes parallel to the length of top 1. This means that the ribs 15 and their ends 9 receive and resist forces only in the plane of the ribs; while the crosspieces 7 receive and resist forces only in directions perpendicular to their length. The legs 3 receive and resist forces substantially only in vertical planes; and as a result, the legs 3, crosspieces 7 and ribs 15 are stressed only in those directions in which they are each best able to resist such stresses. For this reason, it is not necessary to provide any direct connection between ribs 15 and crosspieces 7, whereby a still further simplification of the construction is achieved.

It will also be appreciated that the securement of the legs 3 to the crosspieces 7, and the securement of the crosspieces 7 to the top 1, integrates the legs 3 and the top 1 so that the legs 3 resist racking of top 1.

Figure 4:
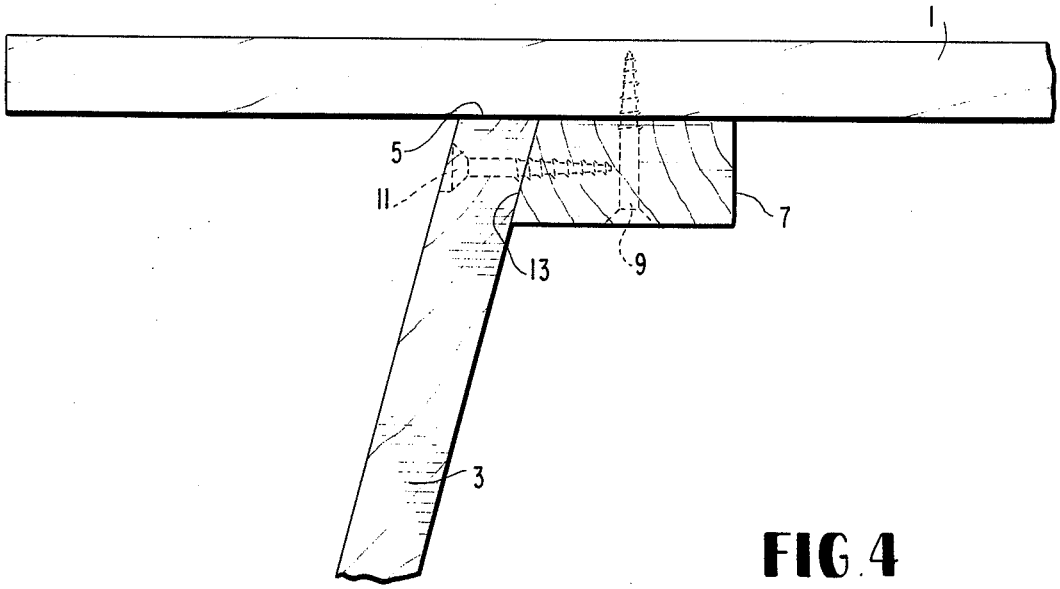
FIG. 4 is a view similar to FIG. 3 but with the ribs removed so as better to illustrate the relationship between the leg, the crosspiece and the tabletop.

In a modification (not shown), with fasteners 21 omitted and fasteners 23 in the form of pivots, and the fasteners 11 omitted and the upper ends of the legs 3 shortened so as not to interfere with tabletop 1, the legs 3 can be mounted for vertical swinging movement between extended positions as shown in the drawings, and collapsed positions reached by counterclockwise movement from the position shown in FIGS. 3 and 4, the legs 3 thus folding almost flat against the underside of ribs 15.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention and defined by the appended claims.

I claim:

1. A wooden table comprising a flat elongated top, a pair of parallel crosspieces secured to the underside of the top adjacent opposite ends of the top and perpendicular to the length of the top, the crosspieces having a length which is most but not all of the width of the top, a pair of parallel ribs extending most of the length of the tabletop, the ribs being disposed at opposite ends of each said crosspiece and extending toward the end of the tabletop beyond each crosspiece and terminating in downwardly depending ends, a pair of flat rectangular legs disposed one adjacent each end of the table, the legs depending downwardly from the table and diverging downwardly away from each other, the upper ends of the legs being disposed between said ends of the ribs and being in contact with the outer side edges of said crosspieces, and means securing said ends of said ribs to the edges of the upper ends of the legs at points spaced a substantial distance below those portions of the lower edges of said ribs that are between said ends of said ribs, the space below said ribs and crosspieces and between said legs being free and open, and fasteners extending through said ribs and up into said top between said ends of said ribs.

2. A table as claimed in claim 1, in which said points of securement of said ends to said legs are disposed a substantial distance below the undersides of said crosspieces.

3. A table as claimed in claim 1, in which said ends are tapered and have inner and outer edges that converge downwardly, said inner edges of said ends being disposed at an obtuse angle to the length of said ribs.

4. A wooden table comprising a flat elongated top, a pair of parallel crosspieces secured to the underside of the top adjacent opposite ends of the top and perpendicular to the length of the top, the crosspieces having a length which is most but not all of the width of the top, a pair of parallel ribs extending most of the length of the tabletop, the ribs being disposed at opposite ends of each said crosspiece and extending toward the end of the tabletop beyond each crosspiece and terminating in downwardly depending ends, a pair of flat rectangular legs disposed one adjacent each end of the table, the legs depending downwardly from the table and diverging downwardly away from each other, the upper ends of the legs being disposed between said ends of the ribs and being in contact with the outer side edges of said crosspieces, and means securing said ends of said ribs to the edges of the upper ends of the legs at points spaced a substantial distance below those portions of the lower edges of said ribs that are between said ends of said ribs, the space below said ribs and crosspieces and between said legs being free and open, and fasteners extending through said upper ends of said legs and into said crosspieces, the upper ends of said legs being chamfered at an angle corresponding to the angle between said legs and said top whereby the upper edges of said legs rest flat against the underside of said top, the edges of said crosspieces being chamfered at an angle corresponding to the angle between said legs and said top whereby the upper ends of said legs rest flat against said crosspieces.

5. A table as claimed in claim 4, in which said points of securement of said ends to said legs are disposed at a substantial distance below the undersides of said crosspieces.

6. A table as claimed in claim 4, and fasteners extending through said ribs and up into said top between said ends of said ribs.

7. A table as claimed in claim 4, in which said ends are tapered and have inner and outer edges that converge downwardly, said inner edges of said ends being disposed at an obtuse angle to the length of said ribs.

* * * * *